US006109577A

United States Patent [19]

Dziedzic

[11] Patent Number: 6,109,577

[45] Date of Patent: Aug. 29, 2000

[54] FLEXIBLE BANDING AND INSTRUMENT SUPPORT SYSTEM

[75] Inventor: Edward Dziedzic, County of Shelby, Tenn.

[73] Assignee: Aluma-Form, Inc., Memphis, Tenn.

[21] Appl. No.: 09/033,095

[22] Filed: Mar. 2, 1998

[51] Int. Cl.[7] ..... G09F 7/18

[52] U.S. Cl. ..... 248/230.8; 248/230.9

[58] Field of Search ..... 248/230.8, 230.9, 248/222.3, 218.4, 219.3, 229.2, 219.4, 74.3; 24/483, 278

[56] References Cited

U.S. PATENT DOCUMENTS

| | | | |
|---|---|---|---|
| 1,653,083 | 12/1927 | Blaw | 248/538 |
| 1,907,889 | 5/1933 | Stauffer | 24/483 |
| 2,383,881 | 8/1945 | Murphy | 40/607 |
| 2,651,094 | 9/1953 | Dodge | 24/279 |
| 2,703,216 | 3/1955 | Peterson | 248/230.9 |
| 2,706,023 | 4/1955 | Merritt | 52/148 |
| 2,780,205 | 2/1957 | Banck | 122/6 A |
| 2,977,995 | 4/1961 | Walpole | 138/99 |
| 3,241,800 | 3/1966 | Richter, III | 248/230.9 |
| 3,374,978 | 3/1968 | Salmon et al. | 211/107 |
| 3,462,110 | 8/1969 | Cheslock | 248/219.4 |
| 3,734,438 | 5/1973 | Kautz | 211/107 |
| 3,750,992 | 8/1973 | Johnson | 211/107 |
| 3,894,707 | 7/1975 | Heard | 248/230.9 |
| 4,066,233 | 1/1978 | Heard | 248/230.8 |
| 4,125,240 | 11/1978 | Heard | 248/218.4 |
| 4,211,381 | 7/1980 | Heard | 248/230.8 |
| 4,325,259 | 4/1982 | Willertz | 73/653 |
| 4,635,888 | 1/1987 | Aldridge et al. | 248/230.9 |
| 4,759,521 | 7/1988 | Aldridge et al. | 248/230.9 |
| 5,098,051 | 3/1992 | Aldridge et al. | 248/230.9 |

*Primary Examiner*—Ramon O. Ramirez
*Assistant Examiner*—Anita M. King
*Attorney, Agent, or Firm*—Paul M Denk

[57] ABSTRACT

A flexible banding and instrument support system for use in securing a support, bracket, and any instrument to a utility pole, or the like, including a flexible band provided substantially surrounding a supporting pole, and capable of conforming to its outer surface, upon tightening. A bracket is mounted on the band. A pair of connectors cooperate with the band ends for securement by a bolt for contracting the band tightly around a pole, and thereby holding the instrument bracket firmly in place. The bracket includes a threaded shaft which extends from the outer or top surface of the bracket, and to which various instruments, such as electrical instruments, wiring, or the like, can be mounted, and thereby obviating the need for any drilled holes through the pole for supporting such instruments.

12 Claims, 3 Drawing Sheets

FLEXIBLE BANDING AND INSTRUMENT SUPPORT SYSTEM

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates generally to the bracketing of instruments, such as electrical components, to a utility pole or the like, and more specifically, to a novel flexible band that can secure brackets and instruments mounted to the brackets directly to a utility pole without necessitating the need for drilling any apertures or inserting any fasteners through the structure of the pole itself while stabley supporting an electrical instrument or related type equipment high upon the erected pole.

A variety of pole bands means that have long been available in the prior art, most of them incorporating some type of a bracket that is held by a band that secures to a pole. Examples of such bands which are mounted about a pole are shown, for example, in U.S. Pat. No. 1,653,083 to Blaw, U.S. Pat. No. 2,383,881, U.S. Pat. No. 2,703,216, to Petersen, U.S. Pat. No. 2,780,205, to Banck, U.S. Pat. No. 3,241,800, to Richter, U.S. Pat. No. 3,374,978, to J. L. Salmon, et al, U.S. Pat. No. 3,462,110, to Cheslock, U.S. Pat. No. 3,734,438, to Kautz, U.S. Pat. No. 3,750,992, to Johnson, U.S. Pat. Nos. 3,894,707, 4,066,233, 4,125,240, 4,211,381, all to Heard, U.S. Pat. No. 4,325,529, to Seebinger, and U.S. Pat. No. 5,098,051, to Aldridge et al.

The currently existing brackets can be improved upon to make them easier to install anywhere along a utility pole and with as few tools as possible.

BRIEF SUMMARY OF THE INVENTION

In view of the foregoing, it is the principal object of this current invention, to provide brackets that may be securely mounted to a utility or other pole, without the need to drill into the pole.

Another object of this invention is to provide contracting connectors that cooperate with the ends of a flexible band to secure the band around a utility or other pole.

A further object of this invention is to provide an instrument supporting system formed from a bracket which is received on the flexible band.

Still another object is to provide such a bracket mounting system that may be readily and promptly installed high upon a utility pole, and done so rather quickly due to the unique construction of the various components that make up this mounting system.

These and other objects may become more apparent to those skilled in the art upon reviewing the summary of this invention, and upon undertaking a study of the description of its preferred embodiment, in view of the drawings.

This invention contemplates a bracket mounting system including a flexible band which can be bound tightly to a utility pole, or to any other structure that requires a bracket so that a device can be mounted to the structure. Examples of other supports include beams, structural columns, pipelines, pilings, and trees, for example. The bracket can be used to supporting various types of electrical equipment or other of a variety of components such as electrical wires, grounding wires, cables, or the like, high upon the utility pole, or other support.

The flexible banding and instrument support system includes a flexible band sized to substantially surround the pole and capable of conforming to the shape of the outer surface of the pole upon tightening of the band around the pole, a pair of connectors which cooperate with each of the free ends of the band, a fastener which extends through the connectors to draw the two connectors together to secure the band to the supporting pole; and a bracket mounted on the band. The bracket includes a base having a base opening therethrough, a top wall opposite said base and having a top opening therethrough, and side walls extending between said base and top wall. The base opening is substantially coaxial with the top wall top wall opening. The bottom wall opening is sized to admit the passage of a head of a bolt therethrough and the top wall opening is sized to allow only the bolt's shaft to pass therethrough, such that the shaft extends from the top wall of the bracket. The bracket also includes a slot through which said band passes. The slot is preferably formed in the side wall of the chamber through which the bracket bolt passes. When the band and brackets are secured to the pole, electrical or other devices and components can be suspended from the bolt shafts, as is known in the art.

The connectors each include an outer portion and an inner portion. The outer portion has a first chamber having a diameter smaller than a diameter of a head of said connector bolt. The inner portion defines a second chamber sized to allow said band to be passed therethrough. The two chambers are separated from each other so that the bolt will not pass from said first chamber to said second chamber. Preferably a pair of shoulders extend inwardly from the sides of the connector to separate the two chambers.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
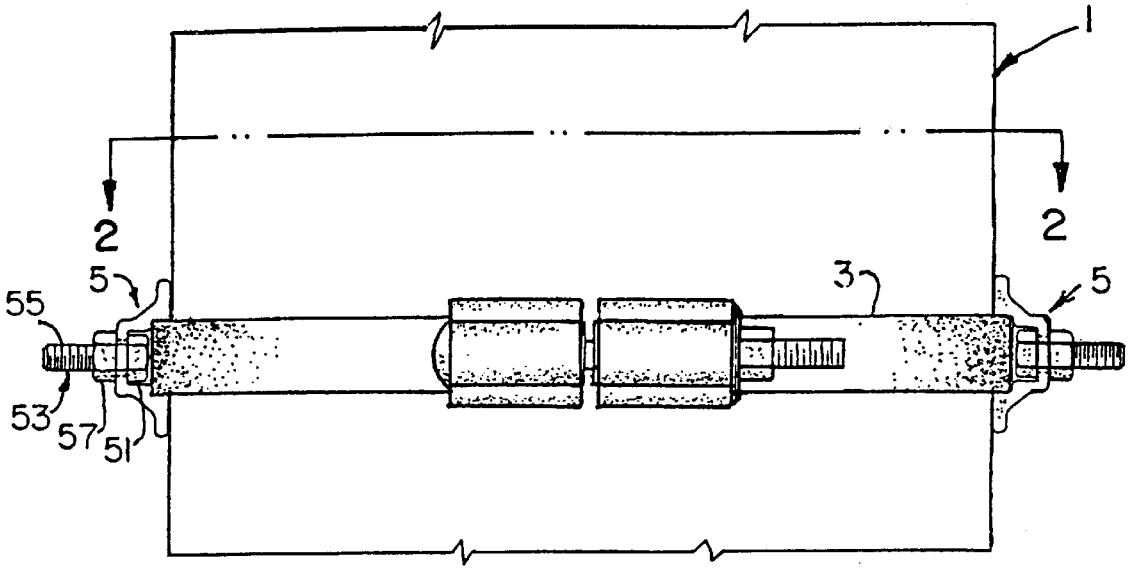
FIG. 1 is an elevational view of a band secured to a pole with a bracket of the present invention mounted on the band, and using clamps of the present invention to secure the band to the pole.
Figure 2:
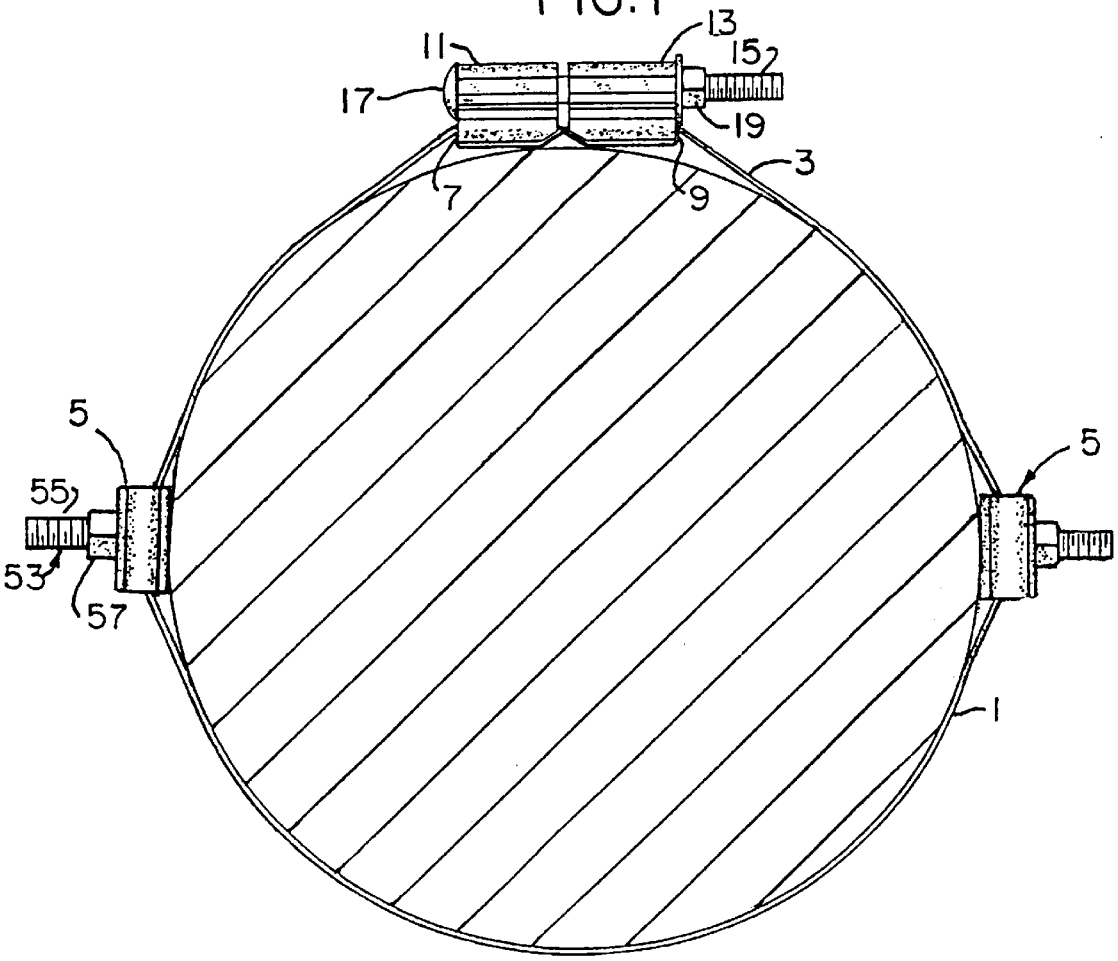
FIG. 2 is a top plan view of the band and bracket mounted to a pole taken along line 2—2 of FIG. 1.
Figure 3:
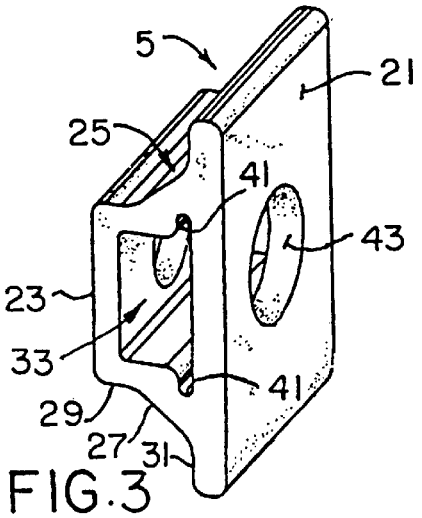
FIG. 3 is a perspective view of a bracket of the present invention.
Figure 9:
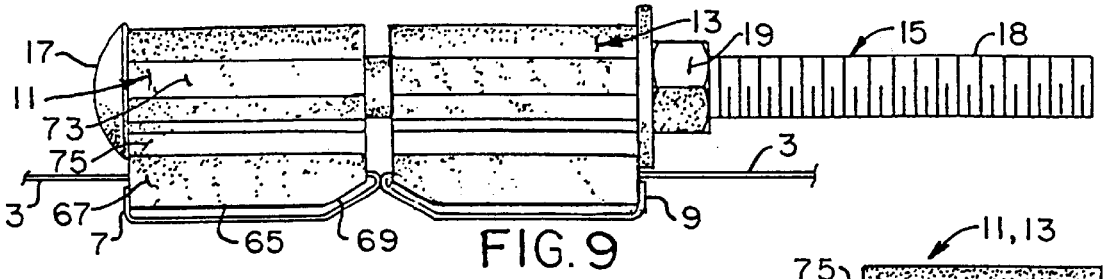
FIG. 9 is a side elevational view of two band retainers connected together.

In referring to the drawings, and in particular FIGS. 1 and 2, there is shown a pole, such as a utility pole 1, or which may be any other style of pole or support for supporting various instruments, wires, or other objects. As shown, a bracket mounting band 3 extends around the pole 3. The band 3 is preferable a flexible band which conforms to the shape of the pole 1. Thus, the band 3 can be used with poles other than round poles. The band 3 is used for mounting one or more brackets 5 to the pole. The back or free ends 7 and 9 of the band 3 extend through a pair of identical band retainers or connectors 11 and 13. The band 3 is turned back upon itself at its ends 7 and 9, as seen in FIG. 9, so that it lays contiguously underneath of each of their respective connectors 11 and 13, intermediate the back of the connectors and the pole surface. Thus, when the connectors 11 and 13 are firmly tightened in place, the band ends 7 and 9 become securely fixed between the pole 1 and the connectors 11 and 13 to fix the band 3 in place around the pole 1. To facilitate the hold of the band 3 to its associated connector, the band may be crimped at its bend location, although this is not an absolute requirement. Each of the connectors 11 and 13 have aligned apertures therethrough, as will be subsequently shown, and through these apertures is arranged a single fastening means, such as the bolt 15, and which bolt includes a head 17 at one end at one end of a shaft 18, and a nut or other fastener 19 at the other end, such that when the nut is tightened upon the bolt shaft 18, the connectors are contracted or drawn together, thereby tightly adhering the band to the pole, and likewise firmly securing the bracket 5 to the pole, for mounting and securing of other instruments.

Figure 4:
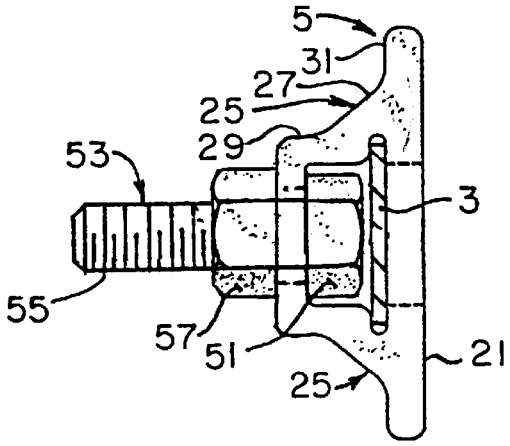
FIG. 4 is a side elevational view of the bracket, with a bolt mounted in the bracket, the bolt being used to mount a device to the bracket.
Figure 5:
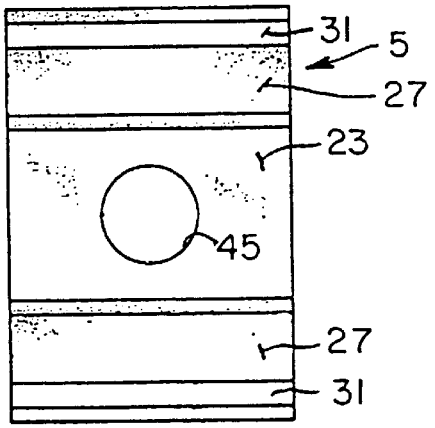
FIG. 5 is a top plan view of the bracket.
Figure 6:
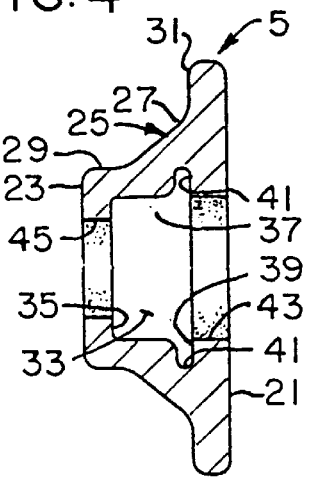
FIG. 6 is a cross-sectional view of the bracket.

One illustrative embodiment of the bracket 5 is shown in FIGS. 3–8. The bracket 5 can be formed of an extruded material, such as aluminum, or any other metal or material which can withstand the environment to which the bracket will be exposed. The bracket 5 is generally trapezoidal in shape, having a generally flat base 21 and a generally flat top or outer surface 23 opposite the base 21. The base 21 and top surface 23 are connected by generally sloping walls 25. The walls 25 include a sloped section 27 extending inwardly and upwardly from the base 21 and a generally vertical section 29 extending from the end of the sloped section 27 to the top surface 23. The bottom of the sloped section 27 of the walls 25 is spaced inwardly from the edges of the base 21. Thus, the bracket 5 includes a pair of flanges 31 which extend outwardly from the bottom of the walls' sloped section 27. The bottom of the flanges 31 and the bottom surface 21 of the bracket are continuous with each other, as seen in FIGS. 1, 4, and 6.

Figure 7:
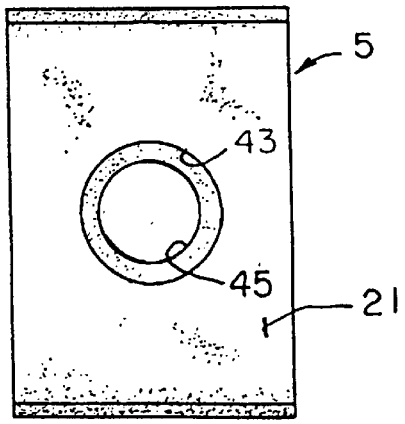
FIG. 7 is a bottom plan view of the bracket.
Figure 8:
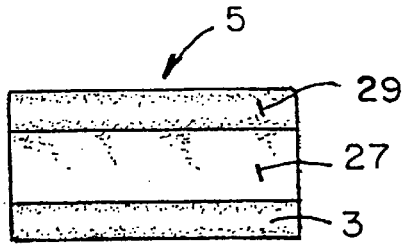
FIG. 8 is a front elevational view of the bracket.

The top, bottom, and walls of the bracket 5 cooperate to form an open ended channel 33 through the bracket 5. The channel 33 is defined by a top surface 35, top surfaces 37 and a bottom surface 39. The bottom surface 39 of the channel 33 extends beyond the channel side surfaces 35 to define a pair of slots or grooves 41. The grooves 41 have a height and width sized to allow the band 3 to pass through the channel 33, as seen in FIG. 4. The bracket 5 also includes an opening 43 in its bottom 21 and an opening 45 in its top 23. The openings 43 and 45 are co-axially aligned, as seen in FIG. 7. However, the bottom opening 43 is larger than the top opening 45. As seen in FIG. 4, the bottom opening is size to allow the head 51 of a bolt 53 to pass therethrough, while the top opening 45 is sized to allow the threaded bolt shaft 55 to pass through it, but not the bolt head 51. The bolt 53 is secured in place in the bracket 5 by a nut 57, as seen in FIG. 4. A desired device can be mounted to the bolt shaft 55 which extends outwardly from the bracket 5, as is known in the art.

As can be appreciated, the bracket 5 is assembled by passing the bolt 53, shaft first, through the bottom opening 43 into the channel 33 until the bolt head 51 engages the top surface 35 of the channel 33. With the bolt shaft 55 extending through the bracket top hole 45, the nut 57 is threaded onto the shaft 55 until it engages the top surface 23 of the bracket 5. Once the bolt has been secured in the bracket 5, the band 2 can be threaded through the bracket groove 41. Importantly, the channel 33 is sized to capture the bolt head to restrain the bolt head 51 from turning during installation and tightening of the nut 57.

A first embodiment of the band connectors 11 and 13 are shown in detail in FIGS. 9–13. The two connectors 11 and 13 are identical. The connectors 11 and 13 include a lower or inner section 61 and an outer or upper section 63. The lower section 61 is defined by a base 65 and generally vertical side walls 67. The base 65 is generally flat, but has a sloped surface 69 at its front. The upper section 63 is defined by a top or outer surface 71 and generally vertical side walls 73. The top section 63 is narrower than the bottom section 61, and the side walls 67 and 73 of the bottom and top sections, respectively, are not co-planar. Rather, a sloped surface 75 extends between the top of the bottom section wall 67 and the bottom of the top section wall 73.

Figure 10:
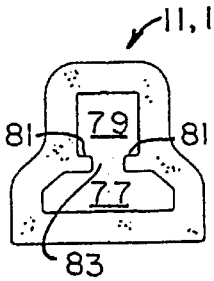
FIG. 10 is a rear elevational view of the retainer.
Figure 11:
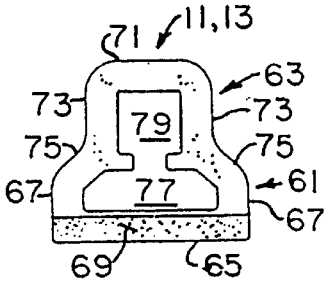
FIG. 11 is a front elevational view of the retainer.
Figure 12:
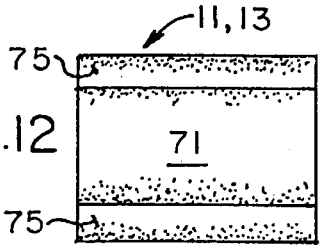
FIG. 12 is a top plan view of the retainer.
Figure 13:
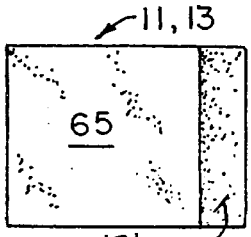
FIG. 13 is a bottom plan view of the retainer.
Figure 14:
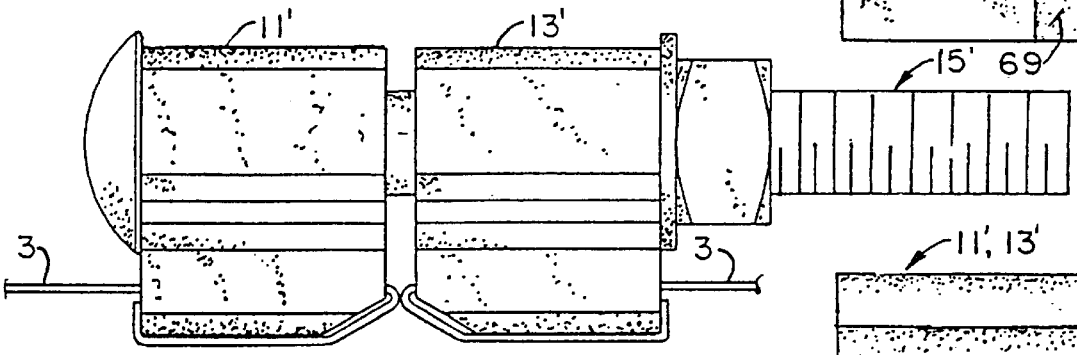
FIG. 14 is a view similar to FIG. 8, but showing a second embodiment of the band retainer.
Figure 15:
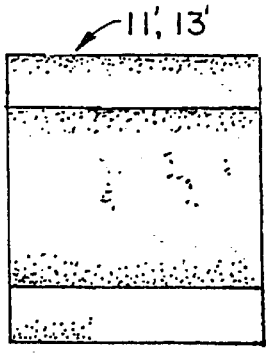
FIG. 15 is a top plan view of the retainer.
Figure 16:
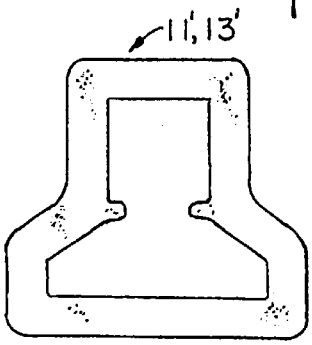
FIG. 16 is a rear elevational view of the retainer.
Figure 17:
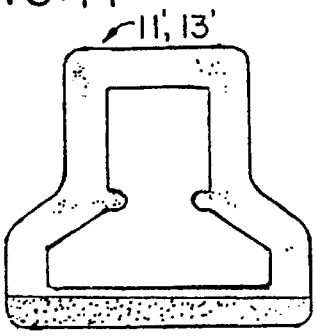
FIG. 17 is a front elevational view of the retainer.
Figure 18:
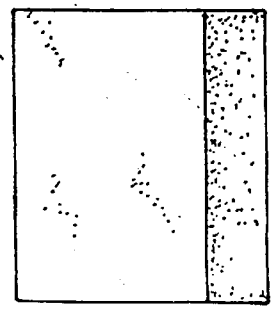
FIG. 18 is a bottom plan view of the retainer.

The lower section 61 defines a lower channel 77 and the upper section 63 defines an upper channel 79. The upper and lower channels 77 and 79 are separated by a pair of inwardly extending shoulders 81, which extend the length of the connectors 11 and 13. As seen in FIGS. 10 and 11, the shoulders 81 do not connect with each other. Thus, the upper and lower channels 77 and 79 are in communication with each other through the gap 83 between the shoulders 81. If desired, the bracket could be formed such that the upper and lower channels are completely separated from each other. The upper channel 79 is sized to accept the shaft 18 of the bolt 15. Although it is shown to be generally rectangular in shape, the upper channel 79 could be generally circular, or any other desired shape. The shoulders 81 are sized such that the gap 83 between the shoulders has a width less than the diameter of the bolt shaft 18. Thus, when the bolt 15 is passed through the connector channel 79, the bolt will not pass from the upper channel 79 into the lower channel 77.

The lower channel 77 is wider than the upper channel. It is sized to allow the band 3 to be passed through it. Although the lower channel 77 is shown to be generally trapezoidal in shape (with a slight vertical wall), the channel could be any other desired shape, such as rectangular, as long as the band 3 can be threaded through the channel 77.

As can be seen in FIG. 9, the band 3 enters the bottom channel 77 from the back end and exits at its front end. The band 3 is wrapped about the sloped surface 69 of the front end, and brought along the bottom surface 65 of the connectors 11 and 13. The ends 7 and 9 of the band are then bent up around the back surface of the connector.

The band 3 is preferably provided with one end of the band already applied to the connector 11, as described above. To apply the band to the pole 1 to mount the brackets 5 on the pole 1, a desired number of brackets 5 are slid onto the band after the bolt 53 is secured in the bracket. The other end of the band is then inserted through the back end of the connector 13. The band 3 is then wrapped around the pole with the surfaces 65 adjacent the pole 1. Thus, the end portions of the band are sandwiched between the pole 1 and the connectors' bottom surfaces 65. The two connectors are positioned such that at least their upper channels 79 are aligned. The bolt 15 is then passed through the two channels, and the nut 19 is threaded onto the bolt's shaft 18. The band 3 is then drawn tight and cut to length. By drawing the band tight, the connectors will be pulled toward one another until they are essentially in contact with each other, as seen in FIG. 9. The nut 19 is then tightened to further draw the connectors together. By drawing the connectors together, the band 3 will be frictionally held in place. The frictional force will prevent the band from becoming lose, and the brackets 5 will thus be securely mounted to the pole 1. Electrical or other devices may then be mounted to the brackets 5.

In FIGS. 14–18, a second embodiment of the connectors is shown. The connectors 11' and 13' are substantially identical to the connectors 11 and 13. However, the connectors 11' and 13' are scaled up in size to accept a larger bolt 15'.

As can be appreciated, the band, connectors, and brackets can be connected together on the ground. The utility worker need only then wrap the band around the pole, pass the bolt through the connectors and tighten the connectors together to secure the brackets 5 to the pole. This may be easily done at any point along the height of the pole, and with a minimum number of tools. Further, because only one band 3 is required to secure the bracket 5 to the pole 1, the mounting of the bracket is easier, than for example the bracket shown in the above noted U.S. Pat. No. 5,098,051, which required two bands to mount the bracket to the pole.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, the bracket bolt 53 can be replaced with a threaded shaft which is secured, for example by welding, to the top surface of the bracket. This would eliminate the need for the openings 43 and 45 in the bottom and top surfaces 21 and 23 of the bracket 5. The brackets 5 are preferably extruded. Thus, although the bracket 5 is shown only with one set of openings 43, 45 to accept only one bolt, the bracket 5 can be made longer to enable two or more threaded shafts to extend from the bracket surface 23. The connectors 11 and 13 could be made with a single channel, similar to the channel 33 of the bracket 5 through which both the bolt 15 and the band 3 extend. These examples are merely illustrative.

What is claimed is:

1. A flexible banding instrument support system for use in securing an instrument to a supporting utility pole or other structure, comprising:

a flexible band sized to substantially surround the pole and capable of conforming to the shape of the outer surface of the pole upon tightening of the band around the pole, said band having a pair of free ends;

a pair of connectors, one connector cooperating with each of the free ends of the band and which when adjusted into a tightened position, draws the band free ends together for securement of the band to the supporting pole;

a bracket held by said flexible band to said supporting pole; said bracket including a base, a top wall opposite said base, side walls extending integrally between said base and top wall, said base, top wall and side walls forming a closed channel, said base and top wall having aligned apertures provided therethrough, and a threaded bolt extending through said top wall, said base, said top wall, and said side walls defining said channel sized to permit said band to also pass therethrough.

2. The flexible banding and instrument support system of claim 1 wherein band passes through said connectors; said system including a connector bolt and a fastener which cooperate to draw the connectors together; said connectors each including a channel through which said connector bolt passes, said connector bolt being sized to pass through both said connectors and extend beyond a second of said connectors; said fastener being mounted to said connector bolt to hold and tighten said connectors together.

3. The flexible banding and instrument support system of claim 2 wherein said connectors each include an outer portion and an inner portion; said outer portion of each connector defining a first chamber; said first chamber having an opening smaller than a diameter of a head of said connector bolt; said inner portion of each connector defining a second chamber sized to allow said band to be passed therethrough; each said connector including a separator between the first and second chambers to prevent said connector bolt from passing from said first chamber to said second chamber.

4. The flexible banding and instrument support system of claim 3 wherein said separator comprises a pair of flanges extending inwardly from inner surfaces of each of said connectors, said flanges being co-planer and separated by a gap; said gap having a width less than the diameter of connector bolt.

5. The flexible banding and instrument system of claim 4 wherein said flanges extend substantially the full length of each of the connectors.

6. A flexible banding instrument support system for use in securing an instrument to a supporting utility pole or other structure, comprising:

a flexible band sized to substantially surround the utility pole and capable of conforming to the shape of the outer surface of the pole upon tightening of the band around the pole, said band having a pair of free ends; a pair of connectors, one connector cooperating with each of the free ends of the band, said band passing through each said connector;

a fastener sized to extend through both of said connectors to draw said connectors together and to draw the band free ends together to secure the band tightly to the supporting utility pole; and a bracket held by said flexible band to said supporting utility pole; said bracket provided to hold a bolt therein, said bolt having a bolt head, said bracket including a base having a base opening therethrough, a top wall opposite said base and having a top opening therethrough, and integral side walls extending between said base and top wall; said bracket base opening being substantially coaxial with the top wall opening; said base opening being sized to admit the passage of said head of a bolt therethrough; said top wall opening having a diameter larger than the diameter of a shaft of said bolt and smaller than the diameter of the head of said bolt; said bolt shaft extending from said bracket top wall and being fixed to said bracket; said bracket further including a slot through which said band passes.

7. A flexible banding and instrument support system for use in securing an instrument to a supporting utility pole or other structure, comprising:

a flexible band sized to substantially surround the pole and capable of conforming to the shape of the outer surface of the pole upon tightening of the band around the pole, said band having a pair of free ends;

a pair of connectors, one connector cooperating with each of the free ends of the band, said band passing through said connectors, a fastener sized to extend through both of said connectors to draw said connectors together and to draw the band free ends together to secure the band tightly to the supporting pole;

a bracket held by said flexible band to said supporting pole and including a threaded shaft of a bolt extending from said bracket; said bracket having an enclosed channel provided therethrough, said channel having at least one aperture provided therethrough, and provided for the extension of the shaft of said bolt therefrom;

said connectors each including an outer portion and an inner portion; said outer portion defining a first chamber having a diameter small than a diameter of a part of said fastener; said inner portion defining a second chamber sized to allow said band to be passed therethrough; said connectors each including a separator between said first and second chambers to prevent said fastener from passing from said first chamber to said second chamber.

8. The flexible banding and instrument support system of claim 7 wherein said separator comprises a pair of flanges extending inwardly from inner surfaces of said connector; said flanges being co-planer and separated by a gap; said gap having a width less than the diameter of said fastener.

9. The flexible banding and instrument system of claim 8 wherein said flanges extend substantially the full length of the connectors.

10. A flexible banding and instrument support system for use in securing an instrument to a supporting utility pole or other structure, comprising:

a flexible band sized to substantially surround the pole and capable of conforming to a shape of the outer surface of the pole upon tightening of the band around the pole, said band having a pair of free ends;

a pair of connectors, one connector cooperating with each of the free ends of the band and which when adjusted into a tightened position, draws the proximate band ends together for securement of the band to the supporting pole;

a bracket held by said flexible band to said supporting pole, said bracket including a base, a top wall opposite said base, side walls extending between said base and top wall, said base, top wall and side walls integrally forming a closed bracket, and a threaded bolt extending through said top wall, said base, top wall, and side walls defining a channel sized to permit said band to pass therethrough;

said bracket base has a bottom opening therethrough and said bracket top wall has a top opening therethrough, said top and bottom openings being substantially coaxially aligned with each other, said bracket provided for holding said threaded bolt of the type including an integral head, said top opening having a diameter larger than the diameter of the threaded bolt and smaller than the diameter of the head of the bolt, said threaded bolt extending from said bracket's top wall and being fixed to said bracket.

11. The flexible banding and instrument support system of claim 10 including a nut; said nut being threaded onto said threaded bolt to fix said bolt to said bracket.

12. A flexible banding and instrument support system for use in securing an instrument to a supporting utility pole or other structure, comprising:

a flexible band sized to substantially surround the pole and capable of conforming to the shape of the outer surface of the pole upon tightening of the band around the pole, said band having a pair of free ends;

a pair of connectors, one connector cooperating with each of the free ends of the band and which when adjusted into a tightened position, draws the band free ends together for securement of the band to the supporting pole;

a bracket held by said flexible band to said supporting pole, said bracket including a base, a top wall opposite said base, side walls extending between said base and top wall, and a threaded bolt extending through said top wall, said base, top wall, and side walls defining a channel sized to permit said band to pass therethrough;

said bracket base has a bottom opening therethrough and said bracket top wall has a top opening therethrough, said top and bottom openings being substantially coaxially aligned with each other, said bracket provided for holding said threaded bolt of the type including an integral head, said top opening having a diameter larger than the diameter of the threaded bolt and smaller than the diameter of the head of the bolt, said threaded bolt extending from said bracket's top wall and being fixed to said bracket.

* * * * *